US006442763B1

(12) United States Patent
Larson et al.

(10) Patent No.: US 6,442,763 B1
(45) Date of Patent: Sep. 3, 2002

(54) INSULATING HOOD

(76) Inventors: Jon C. Larson; Van B. Larson, both of c/o Sure Foot Corporation, 1401 Dyke Ave., Grand Forks, ND (US) 58208-2049

( * ) Notice: Subject to any disclaimer, the term of this patent is extended or adjusted under 35 U.S.C. 154(b) by 0 days.

(21) Appl. No.: 09/757,544

(22) Filed: Jan. 10, 2001

Related U.S. Application Data

(60) Provisional application No. 60/175,185, filed on Jan. 10, 2000.

(51) Int. Cl.[7] ..... A42B 1/04

(52) U.S. Cl. ..... 2/202; 2/424; 2/171; 2/209.11

(58) Field of Search ..... 2/202, 203, 205, 2/204, 171, 410, 208, 171.5, 172, 184.5, 209.11, 424; D2/878

(56) References Cited

U.S. PATENT DOCUMENTS

| | | | | |
|---|---|---|---|---|
| 768,626 A | | 8/1904 | Rautenberg | |
| 991,777 A | | 5/1911 | Goodman | |
| 1,650,258 A | | 11/1927 | Bloomfield | |
| 2,970,318 A | | 2/1961 | Nordling | |
| 2,998,611 A | | 9/1961 | Schuessler | |
| 3,100,896 A | | 8/1963 | Khanbegian | |
| 3,157,887 A | | 11/1964 | Bothstein | |
| 3,169,252 A | | 2/1965 | Goldstein | |
| 3,373,447 A | | 3/1968 | Kim | |
| 3,531,952 A | | 10/1970 | Chesebro | |
| 3,717,882 A | | 2/1973 | Schuessler | |
| 3,747,124 A | | 7/1973 | Zientara | |
| 3,838,467 A | | 10/1974 | Zientara | |
| 4,272,853 A | | 6/1981 | Schuessler | |
| 4,573,217 A | | 3/1986 | Reed | |
| 4,641,380 A | | 2/1987 | Epstein | |
| 5,007,115 A | | 4/1991 | Denbow | |
| 5,035,006 A | | 7/1991 | Hetz | |
| 5,091,996 A | * | 3/1992 | Kirby | 2/206 |
| 5,109,548 A | | 5/1992 | Balaban | |
| 5,109,549 A | | 5/1992 | Mattinson | |
| 5,119,510 A | * | 6/1992 | Schilling | 2/4 |
| 5,309,574 A | | 5/1994 | Balaban | |
| 5,546,605 A | | 8/1996 | Mallardi | |
| D388,239 S | | 12/1997 | Li | |
| 5,765,230 A | | 6/1998 | Sivret | |
| 5,822,800 A | * | 10/1998 | Anderson | 2/202 |
| 5,832,538 A | * | 11/1998 | Williams | 2/202 |
| 5,875,493 A | | 3/1999 | MacDonald | |
| 5,881,389 A | | 3/1999 | Fruge | |
| 6,023,787 A | * | 2/2000 | French et al. | 2/202 |
| 6,088,838 A | | 7/2000 | Sontag | |
| 6,269,489 B1 | * | 8/2001 | Heath | 2/173 |

* cited by examiner

*Primary Examiner*—Gloria M. Hale
*Assistant Examiner*—Alissa L. Hoey
(74) *Attorney, Agent, or Firm*—Patterson Thuente, Skaar & Christensen, P.A.

(57) ABSTRACT

An insulating hood that is suitable for wearing on a person's head. The insulating hood includes a main portion, a resilient portion, an elongated cord, and a pair of lock mechanisms. The main portion has an opening formed therein. The resilient portion is attached to the main portion proximate a lower edge of the opening. The elongated cord at least partially extends through the main portion around the upper edge and side edges of the opening. The pair of lock mechanisms releasably engages the elongated mechanism. Changing the position of the lock mechanisms on the elongated mechanism permits a circumference of the opening to be reduced.

13 Claims, 2 Drawing Sheets

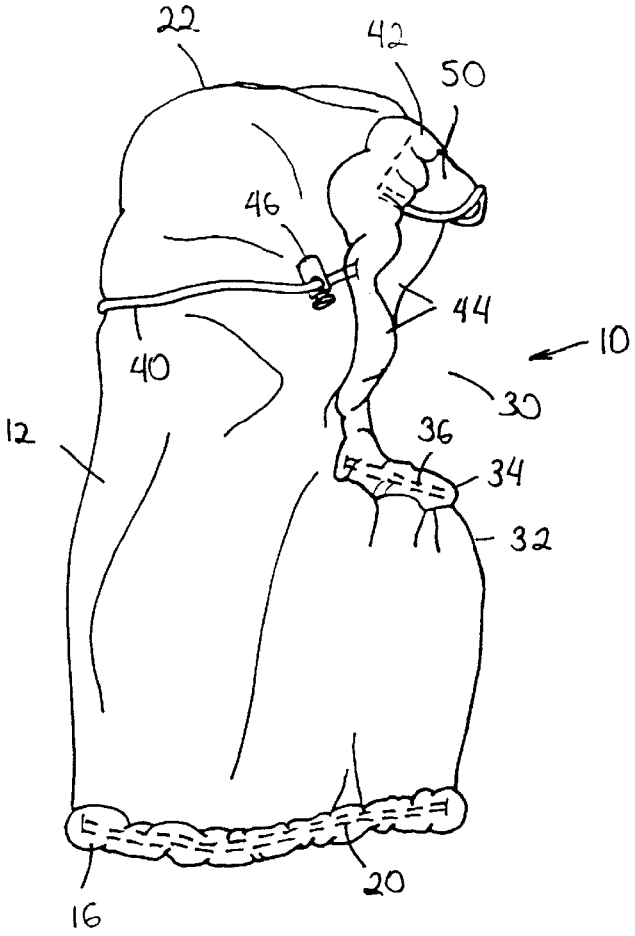
FIG. 1
FIG. 2
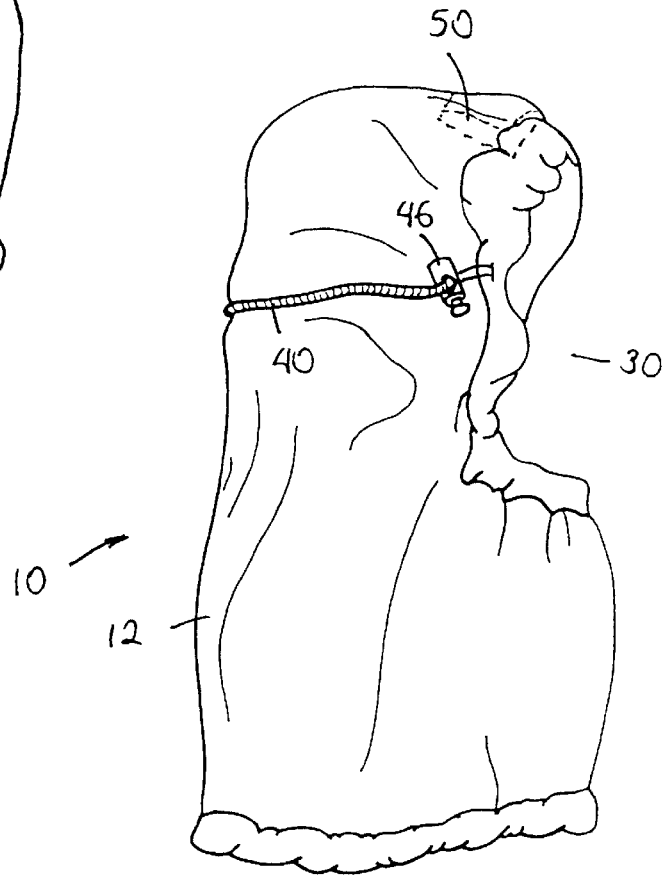

INSULATING HOOD

This application claims the benefit of provisional application No. 60/175,185, filed Jan. 10, 2000.

FIELD OF THE INVENTION

The present invention relates generally to insulating clothing. More particularly, the present invention relates to insulating hood.

BACKGROUND OF THE INVENTION

In many parts of the world, the ambient temperature falls to a point where it is necessary for persons who are exposed to these conditions to cover portions of their bodies to maintain the body at a sufficient temperature that the persons not only protect the body from injury by exposure to the cold temperature but also retain a sufficient amount of the heat radiated from the body proximate the body to minimize the discomfort associated with being in the cold temperatures.

One portion of the human body that radiates a significant portion of heat is through the head. As such, covering portions of the head reduce the amount of heat radiated from the head and thereby increase the person's comfort level at a given ambient temperature. While the most efficient manner to cover the head would be to enclose the entire head, the presence of the eyes, nose, mouth and ears on the head make such an approach unfeasible. As such, items used to protect the head are formed with openings for one or more of the eyes, nose, mouth and ears. Alternatively, the items are formed to protect individual portions of the head such as covering the ears with earmuffs.

The desirability of having one or more of the eyes, nose, mouth and ears exposed depends upon a variety of factors including the ambient temperature and the activity the person is attempting to perform in the reduced temperature region. For example, at extremely cold temperatures it is desirable that only the person's eyes are exposed.

Another factor associated with covering the person's head is that the amount of protection desired by the person wearing the head protection may very significantly during a given day such that significant coverage is desired at times while minimal coverage is desired at other times. To minimize the amount of items that the person must carry, it is desirable for the wear to adjust the amount of protection provided by a single clothing item rather than changing the clothing item when different levels of protection are desired.

Sivret et al., U.S. Pat. No. 5,765,230, discloses a hood having a closed upper end and an open lower end. The hood has a neck cord that extends around the lower end. Changing the length of the neck cord by changing a position of a clamp on the neck cord permits the lower end to be tightened around the wearer's neck. The hood also has an opening for the wearer's face. A face cord extends around a top portion of the opening. Ends of the face cord are joined together at the front portion of the hood with a clamp.

Sontag, U.S. Pat. No. 6,088,838, describes an insulating hood having a hood portion and a neck portion that extends from the hood portion. The neck portion is designed to fold upwardly into the hood portion to provide warmth to the wearer's neck. The hood portion includes an opening for the wearer's face. A cord extends around a top portion of the opening. Ends of the cord are joined together at the back portion of the hood with a clamp.

Fruge, U.S. Pat. No. 5,881,389, discloses an insulating hood for use in cold weather. The insulating hood has an open lower end and a closed upper end. The hood has an opening for a wearer's face. The hood also has openings for the wearer's ears that are closable with flaps attached to the hood. The hood further includes a cord that extends around the face opening and permits the size of the face opening to be changed.

Mattinson, U.S. Pat. No. 5,109,549, discloses a hood that is particularly suited for protecting the head of a person wearing the hood from exposure to fire or other hazardous conditions. The hood includes an open lower end and a closed upper end. The hood also includes an opening for the wearer's face.

SUMMARY OF THE INVENTION

The present invention relates to an insulating hood that is suitable for wearing on a person's head. The insulating hood has a main portion, a bill portion, a first resilient portion, a second resilient portion, an elongated mechanism, and a pair of lock mechanisms.

The main portion has a lower end and an upper end. The lower end is substantially open and is selected with a size to receive the person's head. The upper end is substantially closed and is curved to substantially conform to a top of the person's head. The main portion has an opening formed therein.

The bill portion is attached to main portion proximate an upper edge of the opening. The first resilient portion is attached to the main portion proximate the lower end. The second resilient portion is attached to the main portion proximate a lower edge of the opening.

The elongated cord at least partially extends through the main portion around the upper edge and side edges of the opening. The pair of lock mechanisms releasably engages the elongated cord. Changing the position of the lock mechanisms on the elongated cord permits a circumference of the opening to be reduced.

The insulating hood of the present invention thereby provides a flexible configuration that permits the wearer to adjust the position of the insulating hood on the wearer's head so that the insulating hood provides a high level of insulation, a low level of insulation or an intermediate level of insulation depending on the ambient conditions.

BRIEF DESCRIPTION OF THE DRAWINGS

FIG. 1 is a side view of an insulating hood of the present invention with a bill in an extended position.

FIG. 2 is a side view of the insulating hood with the bill in the retracted position.

DETAILED DESCRIPTION OF THE PREFERRED EMBODIMENTS

Figure 3:
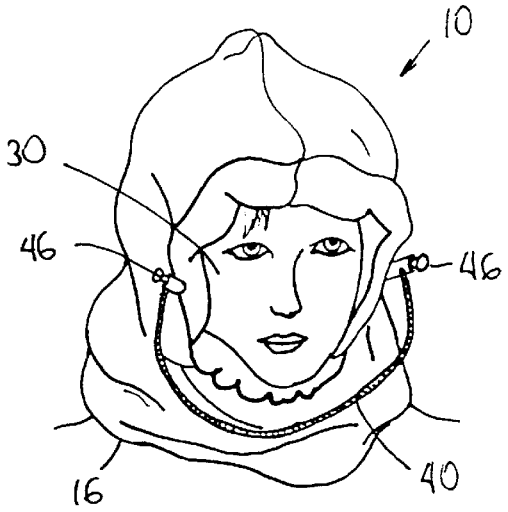
FIG. 3 is a front view of the insulating hood worn on a person's head in a first orientation.

The present invention is directed to an insulating hood, as most clearly illustrated at 10 in FIG. 1. The insulating hood 10 is designed to be worn on a person's head in a variety of orientations such that the person wearing the insulating hood 10 may vary the amount of the person's head that is covered by the insulating hood 10 depending on the ambient conditions.

The insulating hood 10 has a main body portion 12. The main body portion 12 is fabricated with a width that permits the insulating hood 10 to be readily placed over the head of nearly all people who would desire to wear the insulating hood 10. The insulating hood 10 is fabricated with a size that permits the insulating hood 10 to approximately conform to the head of the wearer.

The main body portion 12 is fabricated with a length that is sufficiently long so that the insulating hood 10 extends lower than a wearer's neck when the insulating hood 10 is worn on the person's head. The insulating hood 10 extends lower than an upper portion of the wearer's jacket to prevent cold air from blowing directly onto the neck and upper chest of the person wearing the insulating hood 10.

Proximate a lower edge 16 of the insulating hood 10, the insulating hood 10 has a first resilient portion 20 formed therein. The first resilient portion 20 allows the lower edge 16 to stretch when the insulating hood 10 is placed over the wearer's head. The first resilient portion 20 returns to the constricted position after the insulating hood 10 is placed over the wearer's head to cause the portion of the insulating hood 10 proximate the lower edge 16 to conform with the wearer and substantially prevent cold air from passing between the insulating hood 10 and the wearer's chin.

An upper end 22 of the insulating hood 10 is substantially enclosed. The upper end 22 is preferably curved so that the upper end 22 conforms to the top of the wearer's head. The curved upper end 22 thereby substantially prevents cold air from passing between the insulating hood 10 and the top of the wearer's head.

The insulating hood 10 has an opening 30 formed on a front surface 32 thereof. The opening 30 is formed with a height and width that are approximately the same size as the wearer's face such that when the insulating hood 10 is placed over the wearer's head, the wearer's eyes, nose and mouth extend through the opening 30 but the other portions of the wearer's head are covered by the insulating hood 10.

Proximate a lower edge 34 of the opening 30, the insulating hood 10 has a second resilient portion 36 formed therein. The second resilient portion 36 preferably extends along the entire lower edge 34 of the opening 30. The second resilient portion 36 causes the insulating hood 10 proximate lower edge 34 to conform with the wearer's chin to thereby prevent cold air from passing between the insulating hood 10 and the wearer's chin whether the insulating hood 10 is worn in a position where the lower edge 34 is positioned below the wearer's chin or over the wearer's mouth.

The insulating hood 10 further includes an elastic cord 40 that extends along an upper edge 42 of the opening 30 and partially through side edges 44 of the opening 30. By utilizing the elastic cord 40, the insulating hood 10 is provided with a better, more snug fit that provides the wearer with better visibility. The elastic cord 40 also extends around the back of the insulating hood 10 such that ends of the elastic cord 40 are not exposed.

The elastic cord 40 used in these applications is often referred to as a shot cord. Unlike conventional strings, the elastic cord 40 maintains a relatively curved shape such that when the insulating hood 10 is worn with the elastic cord 40 hanging in front of the wearer, the elastic cord 40 is just below the chin.

A pair of lock mechanisms 46 are provided on a portion of the elastic cord 40 that extends around the back of the insulating hood 10. Adjusting the position of the lock mechanisms 46 on the elastic cord 40 allows the length of the elastic cord 40 that extends through the insulating hood 10 to be changed to reduce the size of the opening 30.

The lock mechanisms 46 are preferably biased in a closed position. Urging the ends of the lock mechanism 46 towards each other moves the lock mechanism 46 to an open position, which allows the elastic cord 40 to pass through the lock mechanism 46 to change the position of the lock mechanism 46 on the elastic cord 40. Once the urging force is discontinued, the lock mechanism 46 returns to the closed position to retain the elastic cord 40 in a fixed position with respect to the lock mechanism 46. While it is possible to use alternative configurations for the lock mechanism 46, the preferred lock mechanism 46 is particularly suited for use in cold weather because the lock mechanism 46 may be readily operated while wearing gloves.

Additionally, forming the elastic cord 40 without exposed ends makes any it much safer by allowing the elastic cord 40 to be drawn around the back of the head and held in place so as not to allow it to fall out of place and hang in front of the neck/chest area. As such, the elastic cord 40 is not allowed to get caught in a moving piece of machinery, such as a snow blower, resulting in injury to the person wearing the insulating hood 10.

If the elastic cord 40 does get pulled with more than a predetermined force, the elastic cord 40 breaks away from the insulating hood 10 allowing the wearer to not be drawn or pulled into a piece of machinery. The ends of the elastic cord 40 are preferably sewn into the insulating hood 10 to permit the ends to pull out under a predetermined force. A person of ordinary skill in the art will appreciate that alternative techniques may be used to releasably attach the ends of the elastic cord 40 in the insulating hood 10.

The insulating hood 10 also has a bill 50 that extends from the upper edge 42 of the opening. The bill 50 reduces the amount of sunlight that impinges upon the eyes of the person wearing the insulating hood 10. The bill 50 is preferably fabricated from a somewhat resilient material that deforms to a curved shape that conforms to the curve of the upper edge 42.

When it is not desired to use the bill 50, the bill 50 folds backwardly so that the bill 50 extends into the interior of the insulating hood 10, as most clearly illustrated in FIG. 2. Such a motion is permitted by sewing the bill 50 along a back edge of the bill 50.

The insulating hood 10 is preferably fabricated from fleece. A preferred material for fabricating the insulating hood 10 is available under the designation COMFORTEMP, which absorbs and stores body heat. When the body cools down, the COMFORTEMP material allows the stored heat to be released to the body. The insulating hood may also be fabricated from a variety of other materials such as cotton, polyester and combinations thereof.

The insulating hood 10 may be partially or totally lined with an additional functional material. One such functional material a referred to as a phase change material for insulation. Another functional material would be a scent blocking material, which is particularly useful when hunting.

The inner and outer surfaces of the insulating hood 10 may be made in a variety of colors and patterns based upon the intended use of the insulating hood 10 such as snowmobiling, skiing and hunting.

The insulating hood 10 of the present invention is adapted for being worn in a variety of different orientations. In a first orientation, the insulating hood 10 is pulled over the head through the bottom opening 16, as most clearly illustrated in FIG. 3. In this orientation, the insulating hood 10 covers the ears and the top, back and sides of the person's head while leaving the eyes, nose and mouth exposed. This orientation is particularly suited for moderately cold weather.

Figure 4:
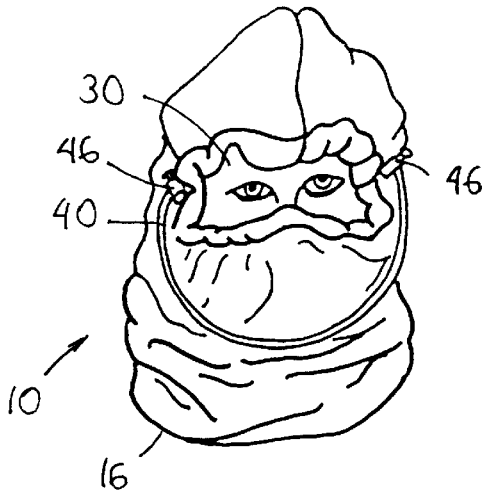
FIG. 4 is a front view of the insulating hood worn on the person's head in a second orientation.

In a second orientation, the insulating hood 10 is pulled over the head through the bottom opening 16 and then the elastic cord 40 is tightened to reduce the side of the face opening 30, as most clearly illustrated in FIG. 4. In this orientation, the insulating hood 10 covers the entire head except for the person's eyes. This orientation is particularly suited for very cold weather.

Figure 5:
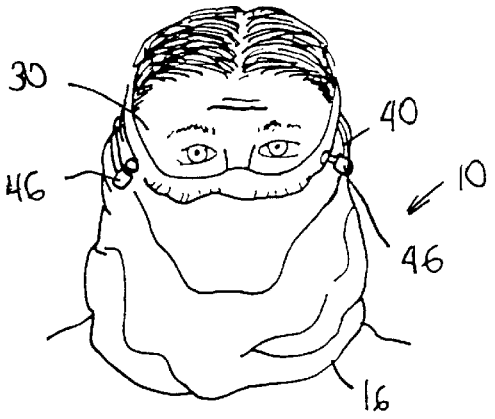
FIG. 5 is a front view of the insulating hood worn on the person's head in a third orientation.

In a third orientation, the insulating hood 10 is placed over the head with a lower edge of the face opening 30 positioned just below the eyes, as most clearly illustrated in FIG. 5. The elastic cord 40 is then tightened to reduce the size of the face opening 30. In this orientation, the insulating hood 10 protects the mouth, nose, and ears. This orientation is particularly suited for moderately cold weather.

Figure 6:
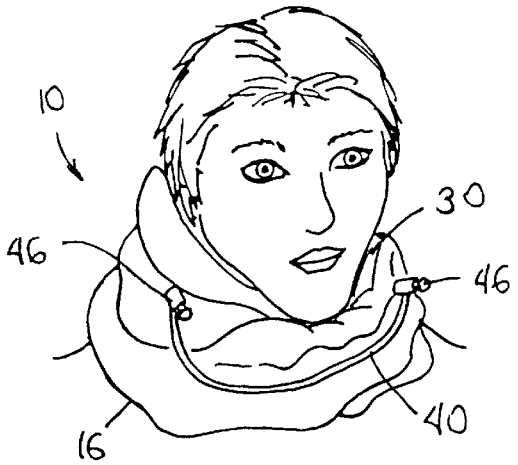
FIG. 6 is a front view of the insulating hood worn on the person's head in a fourth orientation.

In a fourth orientation, the insulating hood 10 is pulled over the head through the bottom opening 16 and the face opening 30, as most clearly illustrated in FIG. 6. In this orientation, the insulating hood 10 protects the neck from cold air while leaving the rest of the person's head exposed. This orientation is particularly suited for mildly cold weather.

It is contemplated that features disclosed in this application, as well as those described in the above applications incorporated by reference, can be mixed and matched to suit particular circumstances. Various other modifications and changes will be apparent to those of ordinary skill.

What is claimed is:

1. An insulating hood for insulating a person's head, the insulating hood comprising:

a main portion having a lower end and an upper end, the lower end being substantially open and is selected with a size to receive the person's head, the upper end being substantially closed and being formed to substantially conform to a top of the person's head, the upper end having a face opening formed therein defined by a face opening periphery;

an elongate elastic cord at least partially within a sewn channel proximate the face opening periphery, wherein the elongate elastic cord defines an upper face seal that extends from a temple area across a forehead area and concludes at an opposing temple area of the person's head, and wherein the elastic cord passes through apertures in the face opening periphery proximate the respective temples and forms a continuous loop;

a resilient portion disposed within a channel proximate the face opening periphery, wherein the resilient portion defines a lower face seal, wherein the lower face seal is selectively adjustable to conform to the person's head from an under the jaw disposition to an above the nose disposition; and a pair of lock mechanisms that releasably engage the elongate elastic cord, wherein changing the position of the lock mechanisms on the elongate elastic cord relative to the face opening permits the face opening periphery to be adjusted.

2. The insulating hood of claim 1 wherein the face opening is selected with dimensions suitable for permitting the person's eyes, nose and mouth to extend therethrough.

3. The insulating hood of claim 1 wherein the face opening is selected with suitable dimensions for permitting the person's head to extend therethrough.

4. The insulating hood of claim 1, wherein reducing the periphery of the face opening permits only one or more of the person's eyes, nose and mouth to be exposed.

5. The insulating hood of claim 1 wherein the insulating hood substantially conforms to the top portion of the person's head.

6. The insulating hood of claim 5 wherein the lower end substantially conforms to a neck of the person wearing the insulating hood.

7. The insulating hood of claim 1 wherein the elongate elastic cord is made of a shot cord type material.

8. The insulating hood of claim 7, wherein the exposed portion of the cord is continuous, the cord having first and second ends, the first and second ends being secured to the hood proximate each other at an apex of the face opening periphery.

9. The insulating hood of claim 8 wherein the cord is secured by stitching to form a breakaway attachment, the breakaway attachment allowing the elongate elastic cord to readily disengage from the main portion upon the imparting of a certain force to the continuous portion of the cord.

10. An insulating hood for insulating a person's head, the insulating hood comprising:

a main portion having a lower end and an upper end, the lower end being substantially open and is selected with a size to receive the person's head, wherein the upper end is substantially closed and is formed to substantially conform to a top of the person's head, and wherein the upper end has a face opening formed therein defined by a face opening periphery;

an elongate elastic cord at least partially extending through a first portion of the face opening periphery and exiting from the face opening periphery to form an exposed continuous loop, wherein the cord has first and second ends, wherein the first and second ends are secured to the hood by stitching to form a breakaway attachment proximate each other at an apex of the face opening periphery, and wherein the breakaway attachment allows the elongate elastic cord to readily disengage from the main portion upon the imparting of a selected force to the continuous portion of the cord; and a pair of lock mechanisms that releasably engage the elongate elastic cord, wherein changing the position of the lock mechanisms on the elongate elastic cord relative to the face opening permits the face opening periphery to be adjusted.

11. The insulating hood of claim 10, wherein the face opening is selected with dimensions suitable for permitting the person's eyes, nose and mouth to extend therethrough.

12. The insulating hood of claim 10, wherein the insulating hood substantially conforms to a top portion of the person's head.

13. The insulating hood of claim 10, wherein the lower end substantially conforms to a neck of the person wearing the insulating hood.

* * * * *